United States Patent [19]

Sweet

[11] 4,109,749

[45] Aug. 29, 1978

[54] MUFFLER

[75] Inventor: Lawrence A. Sweet, Lakeland, Minn.

[73] Assignee: Minnesota Mining and Manufacturing Company, Saint Paul, Minn.

[21] Appl. No.: 740,302

[22] Filed: Nov. 9, 1976

[51] Int. Cl.[2] ..... G10K 11/04; F01N 1/08

[52] U.S. Cl. ..... 181/230; 181/265; 181/275; 181/281

[58] Field of Search ..... 181/230, 231, 256, 238, 181/264, 265, 268, 275, 281; 179/1 UW; 128/141 R, 141 A

[56] References Cited

U.S. PATENT DOCUMENTS

| | | | |
|---|---|---|---|
| 663,725 | 12/1900 | Buck | 181/265 |
| 3,547,223 | 12/1970 | Gibel | 181/230 |
| 3,712,415 | 1/1973 | Blatt et al. | 181/264 |
| 3,949,828 | 4/1976 | Frochaux | 181/230 |

FOREIGN PATENT DOCUMENTS

| | | | |
|---|---|---|---|
| 66,955 | 5/1969 | German Democratic Rep. | 181/238 |

*Primary Examiner*—Stephen J. Tomsky
*Attorney, Agent, or Firm*—Cruzan Alexander; Donald M. Sell; Edward T. Okubo

[57] ABSTRACT

A noise attenuator or muffler for a compressed air tube type heater is disclosed. The muffler exhaust air through exit apertures located about its periphery and due to its unique design substantially avoids the formation of ice in the muffler.

4 Claims, 2 Drawing Figures

MUFFLER

Background of the Invention

The present invention relates to a noise attenuator or muffler for a compressed air tube heater forming a part of a supplied air respiratory system.

Tube type heaters provide hot air when compressed air is injected into a chamber through tangential slots which creates a miniature cyclone with extremely high revolution per minute in the generator. From this generator, the swirling air passes through an orifice and expands into a vortex tube. As the air moves through the tube, the outer portion becomes hot and is imposed on by a restriction at the end of the tube which taps off and channels the hot air through a diffuser and into the helmet. The degree of heating is controlled by varying the airflow through the heater, maximum heating being achieved when airflow is highest through the heater.

It will be recognized that the air which is not discharged through the tube heater as hot air is exhausted from the other end of the tube as cold, usually freezing, air. This exhaust air can be extremely noisy and must be muffled to comply with noise level requirements established by pertinent governmental agencies such as the National Institute of Occupational Safety and Health (NIOSH). Prior mufflers have generally taken the form of simple cylinders packed with foam, felt or sintered bronze and attached to the exhaust end of the heater. However, since the exhaust air was at below freezing temperatures, these mufflers frequently suffered from an icing condition. When icing occurs in the mufflers, the performance of the heater, and therefore, the respiratory system, is greatly degraded.

SUMMARY OF THE INVENTION

The present invention relates to a muffler for a compressed air tube heater. In the muffler of the present invention, cold exhaust air is directed into the center of a foam cylinder where it impinges upon an end cap, thence down the sides of the foam cylinder where it exits around the bottom periphery of the cylinder and finally to atmosphere around the outside of the foam cylinder and the interior of the muffler housing. Noise attenuation is accomplished by absorption of sound waves by the foam cylinder.

BRIEF DESCRIPTION OF THE DRAWINGS

In the accompanying drawings which illustrate the invention.

DETAILED DESCRIPTION OF THE INVENTION

Figure 1:
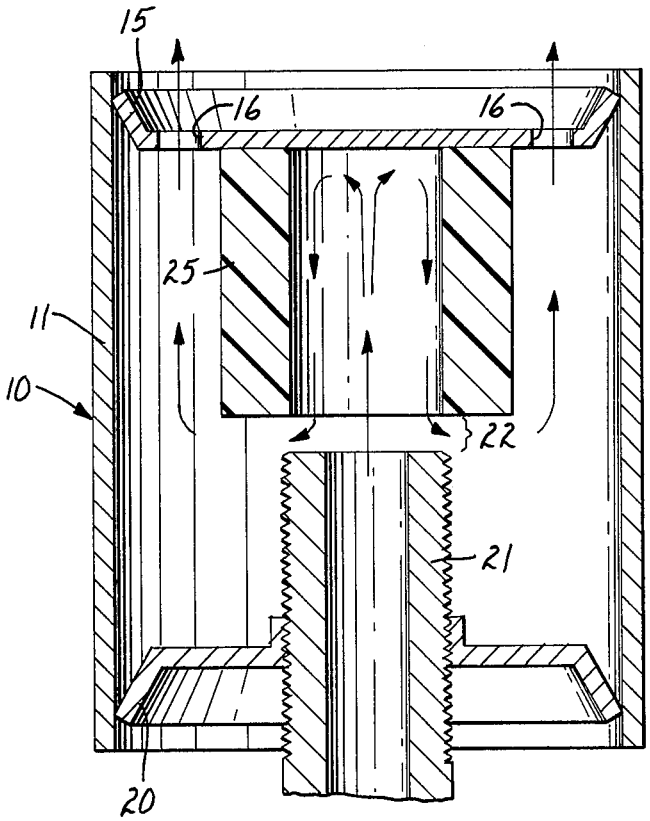
FIG. 1 is an enlarged sectional view of a muffler of the present invention in which the air path through the muffler is indicated by arrows.
Figure 2:
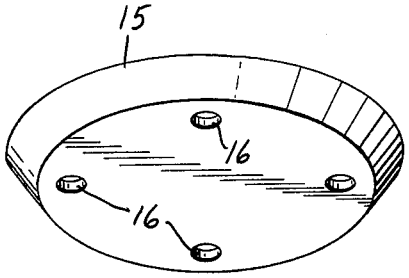
FIG. 2 is a perspective view of the outlet end of the muffler of FIG. 1.

Referring now more particularly to the drawings, muffler 10 comprises housing 11, exhaust cap 15, inlet cap 20 and muffler pad 25.

Inlet cap 20 and exhaust cap 15 are crimped onto housing 11 to form a unitary structure. Inlet cap 20 is typically formed of commercially available low cabon, soft temper cold rolled sheet metal of approximately 0.060 inch thickness. The cap is drawn into a dished shape having a depth of about 0.20 inch at the same time as it is stamped from the stock sheet. The center of the inlet cap is pierce extruded and threaded to accept a standard ¼ inch pipe nipple 21 provided on the tube heater (not shown).

Exhaust cap 15 is typically formed of commercially available cold rolled annealed spring steel of approximately 0.025 inch thickness and is stamped from the roll stock in the usual manner. Exhaust cap 15 is provided with four apertures 16 equidistantly placed around the periphery of the cap through which the exhaust is dumped to atmosphere.

Muffler pad 25 is formed as an open-ended cylinder from sound absorbing material, the presently preferred material being an open cell polyurethane ether foam. The cylindrical foam muffler pad 25 is affixed to the exhaust cap 15 such that there are no exit apertures 16 communicating with the center of the cylinder. Thus, inlet air entering the muffler 10 will impinge onto the exhaust cap 15 and exit the cylindrical muffler pad 25 along the inner periphery of the foam cylinder. A small amount of the air may pass through the foam, of course. Noise attenuation is accomplished by the absorption of sound waves in the foam.

Once the air exits the interior of muffler pad 25 it is forced to find an exhaust path between the outer periphery of pad 25 and the inner periphery of housing 11 at which time the second stage of noise attenuation occurs by the process of sound wave absorption by the foam as the air passes the muffler pad 25. The air exits muffler 10 through the four exit apertures 16 which are located approximately 90° apart adjacent the periphery of exhaust cap 15.

As will be clearly seen from FIG. 1, air exiting the interior of muffler pad 25 around its bottom periphery along its way to exit apertures 16 must pass through gap 22 formed by the bottom edge of pad 25 and the top edge of nipple 21. Tests have shown that gap 22 must have a minimum width of 1/16 inch in order to avoid ice formation at the gap. It has also been determined that as the size of gap 22 increases, the noise level also increases. Accordingly, it has been found that gap 22 should not exceed about ⅛ inch in width.

It has also been experimentally established that in order for a muffler to meet the noise level requirements and also enable the heater to provide the degree of heated air necessary for a supplied air respiratory system particular attention had to be paid to factors such as exit aperture location and size and muffler length.

In order to obtain data to determine the parameters such as optimum numbers, location and size of the exit apertures 16, a bench test was devised. The bench test involved placing a sound level meter a fixed distance from the muffler and measuring the sound level (dbA) of the variously configured mufflers. For reproducibly measured air flow and heat output of the tube heater, the bench test included an air flow meter and thermometer in the hot air stream.

Utilizing the above described bench test set-up, it was found that acceptable sound levels, temperature output and air flow were obtained in a muffler having from ⅛ inch exit apertures spaced 90° about the periphery of the exhaust cap. Tests were conducted on mufflers having two through six exit apertures measuring from 0.094 inch to 0.188 inch in diameter. The tests showed that as the exhaust area was increased, the temperature increased as did the sound level.

The bench test was also used to determine a practical muffler length. Mufflers measuring from 1.75 inch to 2.75 inches in length were tested and were all found to perform satisfactorily, i.e., met all of the NIOSH sound level requirements. Since the tube type heaters on which mufflers of the present invention are employed are customarily worn on the belt of the worker, it was decided that the shortest acceptable muffler would be most desirable from the standpoint of bulk and weight. Accordingly, the presently preferred muffler is 1.75 inches in length.

All of the test mufflers were equipped with a muffling element comprising cylindrical muffler pads 25 formed of a sound absorbing foam. Although the foam was used as the muffling element for reasons of economy and handling ease, other sound attenuating materials such as felt which can be formed into cylinders are useful in the present invention as muffler pads.

In order to test mufflers constructed according to the principles of the present invention over an extended period, five mufflers were installed onto a Vortemp Brand Air Heater, available commercially from 3M Company, and operated under the following conditions:

Supply Air Pressure: 60 psig
Outlet Air Volume: 6.9 scfm
Incoming Temp. of Supply Air: 72° F.
Temp. of Outlet Air: 130° F.

After seven hours of continuing operation under the above conditions, a reading was taken of one of the test rigs (heater and muffler) with the following results:

Supply Air Pressure: 60 psig
Outlet Air Volume: 7.0 scfm
Incoming Temp. of Supply Air: 72° F.
Temp. of Outlet Air: 131° F.

The above data shows conclusively that the mufflers of the present invention performed satisfactorily, i.e., meets all applicable NIOSH requirements, over an extended period with no significant degradation in performance of the tube heater on which it was installed.

What is claimed is:

1. A muffler for a compressed air tube heater comprising a cylindrical housing, an inlet cap fixed to one end of said housing and an air inlet nipple connected to and extending through said cap, an exhaust cap fixed on the other end of said housing and having a plurality of apertures adjacent its periphery and a cylindrical muffler pad for attenuating sound therein, said muffler pad being affixed at one end to the interior of said exhaust cap such that said plurality of apertures is outside the area of said muffler pad, the path through said muffler being serpentine in that air is directed through the center of said cylindrical muffler pad onto the exhaust cap, thence returned back along the inner periphery of said muffler pad, through a gap formed by the free edge of said muffler pad and the top edge of said air inlet nipple, thence to atmosphere along the outer periphery of said muffler pad and the interior of said muffler housing through said plurality of apertures along the peripheral edge of said exhaust cap.

2. A muffler according to claim 1 wherein said muffler pad is a sound absorbing cylinder formed of a polyurethane ether foam.

3. A muffler according to claim 1 wherein the gap formed by the free edge of said muffler pad and the air inlet nipple is at least 1/16 inch wide.

4. A muffler according to claim 1 wherein the exhaust cap is provided with four exit apertures equidistantly spaced along its peripheral edge.

* * * * *

UNITED STATES PATENT AND TRADEMARK OFFICE

CERTIFICATE OF CORRECTION

PATENT NO. : 4,109,749

DATED : August 29, 1978

INVENTOR(S) : Lawrence A. Sweet

It is certified that error appears in the above-identified patent and that said Letters Patent are hereby corrected as shown below:

Column 2, line 59, "from" should be changed to -- four --;

Column 4, line 8, "on" should be changed to -- to --.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*